United States Patent [19]

Ito et al.

[11] Patent Number: 4,704,564

[45] Date of Patent: Nov. 3, 1987

[54] CONVERGENCE CORRECTION APPARATUS

[75] Inventors: Masaaki Ito, Iwai; Toshio Kobayashi, Noda, both of Japan

[73] Assignee: Victor Company of Japan, Ltd., Tokyo, Japan

[21] Appl. No.: 889,331

[22] Filed: Jul. 23, 1986

[30] Foreign Application Priority Data

Jul. 24, 1985 [JP] Japan ..... 60-163644

[51] Int. Cl.[4] ..... H01J 29/70; H01J 29/76

[52] U.S. Cl. ..... 315/368; 315/400

[58] Field of Search ..... 315/368, 400, 371, 407

[56] References Cited

U.S. PATENT DOCUMENTS 3,902,100 8/1975 Nakagawa et al. ..... 315/400

FOREIGN PATENT DOCUMENTS 0145483 6/1985 European Pat. Off. ..... 315/368
57-206184 12/1982 Japan .
58-14453 1/1983 Japan .
60-125069 7/1985 Japan .
61-65658 5/1986 Japan .

*Primary Examiner*—Theodore M. Blum
*Assistant Examiner*—Gregory C. Issing
*Attorney, Agent, or Firm*—Michael N. Meller

[57] ABSTRACT

A convergence correction apparatus comprises a pair of horizontal deflecting coils and a pair of vertical deflecting coils constituting a deflection yoke of a self-convergence system color picture tube, saturable reactors for correcting convergence error in horizontal lines by varying a distribution of a horizontal deflection magnetic field with time, auxiliary control coils coupled to the vertical deflecting coils and wound of the saturable reactors for varying inductances of coils of the saturable reactors by auxiliary control magnetic fields generated by the auxiliary control coils, and a correcting circuit for supplying to the auxiliary control coils a current which has a waveform other than a sawtooth waveform and has a period equal to the vertical deflection period, and for non-linearly varying magnitudes of the auxiliary magnetic fields generated thereby.

8 Claims, 19 Drawing Figures

CONVERGENCE CORRECTION APPARATUS

BACKGROUND OF THE INVENTION

The present invention generally relates to convergence correction apparatuses, and more particularly to a convergence correction apparatus for correcting a misconvergence pattern generated in a self-convergence system color picture tube comprising in-line type electron guns.

Generally, in a color picture tube used in a color television receiver, electron beams emitted from three electron guns must not only be focused on a fluorescent screen, but the electron beams must also be converged in the same aperture of a shadow mask. For this reason, in the conventional color picture tube comprising the in-line type electron guns, a horizontal deflection magnetic field generated by a deflection yoke is of a strong pincushion type and a vertical deflection magnetic field generated by the deflection yoke is of a strong barrel type in order to obtain a satisfactory focusing of the three electron beams on the fluorescent screen and accordingly obtain a satisfactory convergence.

However, in a case where the deflection angle of the color picture tube is set to a large angle such as 90°, a pincushion distortion or a barrel distortion is generated in upper and lower rasters when the deflection magnetic fields are adjusted so as to obtain a satisfactory convergence. On the other hand, when the distortions in the upper and lower rasters are adjusted within a tolerable range, a positive cross misconvergence (hereinafter referred to as a positive trilemma misconvergence) or a negative cross misconvergence (hereinafter referred to as a negative trilemma misconvergence) is generated. Accordingly, it is virtually impossible or extremely difficult technically to simultaneously obtain a satisfactory convergence characteristic and tolerable distortions in the upper and lower rasters.

Accordingly, convergence correction apparatuses have been previously proposed in Japanese Laid-Open Patent Application Nos. 57-206184 and 58-14453 in which the applicant is the same as the assignee of the present application. The proposed convergence correction apparatuses comprise saddle-shaped horizontal deflecting coils and toroidal vertical deflecting coils which constitute the deflection yoke, and a reactor which changes its impedance with a vertical deflection period and is coupled to each of the horizontal deflecting coils. The circuit impedance of the horizontal deflecting coils is varied differentially by the reactors so as to correct the positive or negative trilemma misconvergence pattern by changing the horizontal deflection magnetic field distribution with time.

However, even in the proposed convergence correction apparatuses, there are problems in that the misconvergence pattern including the positive trilemma misconvergence pattern generated due to insufficient convergence correction at the central portion of the screen and the negative trilemma misconvergence pattern generated due to excess convergence correction at the peripheral portion of the screen is generated. It is extremely difficult to correct this kind of a misconvergence pattern by the conventional technology for the following reasons.

As a method of correcting the misconvergence pattern described above, there is a method disclosed in the Japanese Laid-Open Patent Application No. 57-206184 described before. According to this method, a D.C. magnetic bias quantity of permanent magnets is made small, and an operating range of control magnetic fields acting on the reactors is shifted accordingly. In order to obtain such an operating range, it is not only necessary to make the D.C. magnetic bias quantity small, but it is also necessary to make the diameters of drum-shaped cores which constitute the reactors considerably small. As a result, there are problems in that the yield of the drum-shaped cores becomes poor, the drum-shaped cores break easily when the coils are wound thereon, and it is difficult to mass produce the reactors.

Presently, it is impossible to completely eliminate the misconvergence described heretofore. For this reason, the color television receivers are produced by distributing the convergence error throughout the entire screen and performing adjustments so that the error appears on the average at each point of the screen. On the other hand, in a super or high fineness (resolution) picture tubes having a dot pitch of 0.21 to 0.31 mm on the screen, it is ideally desirable to make the convergence error to within 0.2 mm. However, it requires a highly skilled operator to adjust the convergence error to within such a small value, and it takes an extremely long time to make such an adjustment. Furthermore, it is extremely difficult to make such adjustments and constantly produce deflection yokes of satisfactory quality. In other words, it is extremely difficult to mass produce inexpensive deflection yokes which satisfy the demand for the small misconvergence.

SUMMARY OF THE INVENTION

Accordingly, it is a general object of the present invention to provide a novel and useful convergence correction apparatus in which the problems described heretofore are eliminated.

Another and more specific object of the present invention is to provide a convergence correction apparatus comprising a pair of horizontal deflecting coils and a pair of vertical deflecting coils constituting a deflection yoke of a self-convergence system color picture tube in which dynamic convergence alignment of three electron beams from three electron guns having an in-line arrangement is automatically performed by horizontal and vertical deflection magnetic fields, saturable reactors for correcting convergence error in horizontal lines by varying differentially a horizontal deflecting coils depending on a vertical deflection period and the horizontal deflection current so that a distribution of the horizontal deflection magnetic field is changed with time, auxiliary control coils coupled to the vertical deflecting coils and wound of the saturable reactors for varying inductances of coils of the saturable reactors by auxiliary control magnetic fields generated by the auxiliary control coils, and correcting means for supplying to the auxiliary control coils a current which has a waveform other than a sawtooth waveform and has a period equal to the vertical deflection period, and for non-linearly varying magnitudes of the auxiliary magnetic fields generated thereby. According to the convergence correction apparatus of the present invention, it is possible to non-linearly vary the magnitudes of the auxiliary control magnetic fields by the correcting means, and non-linearly vary the inductances of the coils of the saturable reactors. Hence, it is not only possible to reduce the extent of the increase in the convergence correction quantity at the peripheral portion of the screen, but it is also possible to reduce the extent of the convergence correction quantity at the peripheral portion of the screen. In addition, since the waveform of the current supplied to the auxiliary control coils can be set arbitrarily, it is possible to perform convergence correction of various misconvergence patterns. For this reason, it is possible to satisfactorily correct the misconvergence pattern which is conventionally generated because the misconvergence quantity and the correction quantity do not coincide in control magnetic fields generated by the conventional sawtooth deflection current. As a result, it is possible to perform a considerably improved convergence alignment and also reduce the production cost of the deflection yoke.

Still another object of the present invention is to provide a convergence correction apparatus in which inductance change curves of the coils of the saturable reactors coupled to the horizontal deflecting coils are set to optimum curves which are in accordance with the misconvergence pattern. According to the convergence correction apparatus of the present invention, it is possible to make the convergence error quantity and the convergence correction quantity coincide throughout the entire screen.

A further object of the present invention is to provide a convergence correction apparatus in which the convergence alignment is considerably improved by modifying the conventional convergence correction apparatus which uses the saturable reactors.

Other objects and further features of the present invention will be apparent from the following detailed description when read in conjunction with the accompanying drawings.

DETAILED DESCRIPTION

Figure 1A:
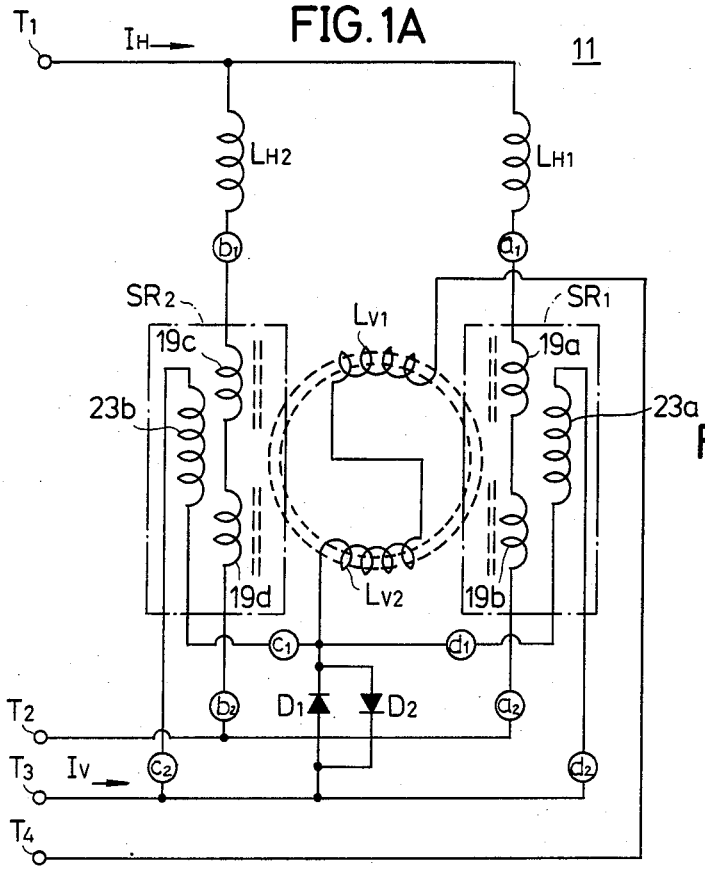
FIGS. 1A and 1B are circuit diagrams respectively showing an embodiment of the convergence correction apparatus according to the present invention and another embodiment of an essential part thereof.
Figure 1B:
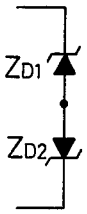

In FIGS. 1A through 3, a deflection yoke 11 is constituted by a pair of saddle-shaped horizontal deflecting coils $L_{H1}$ and $L_{H2}$ and a pair of toroidal vertical deflecting coils $L_{V1}$ and $L_{V2}$.

A pair of core portions 12 and 13 wound with the vertical deflecting coils $L_{V1}$ and $L_{V2}$ are brought face to face with each other and are connected at joints 16 and 17 thereof to form a cylindrical core. The core portions 12 and 13 are assembled on top of a separator 14 made of an insulative material such as plastics, and are fixed together by clampers 15. A pair of saturable reactors SR1 and SR2 which constitute an essential part of the convergence correction apparatus according to the present invention are mounted on the outside of the cylindrical core and in vicinities of the joints 16 and 17.

Figure 2:
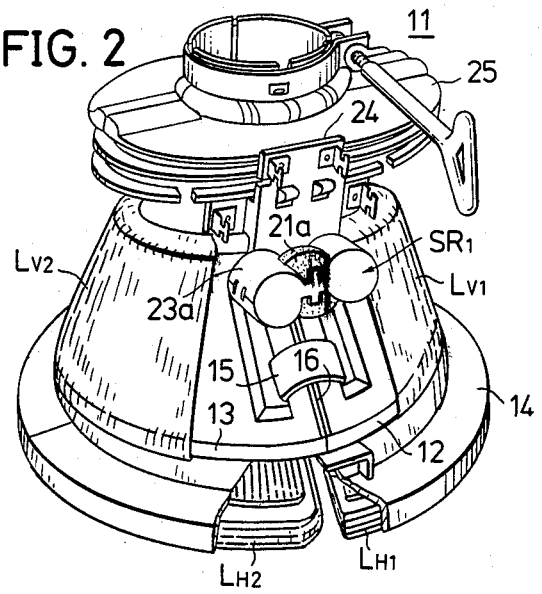
FIGS. 2 and 3 are a perspective view and a cross sectional view respectively showing a deflection yoke applied with the convergence correction apparatus according to the present invention.
Figure 3:
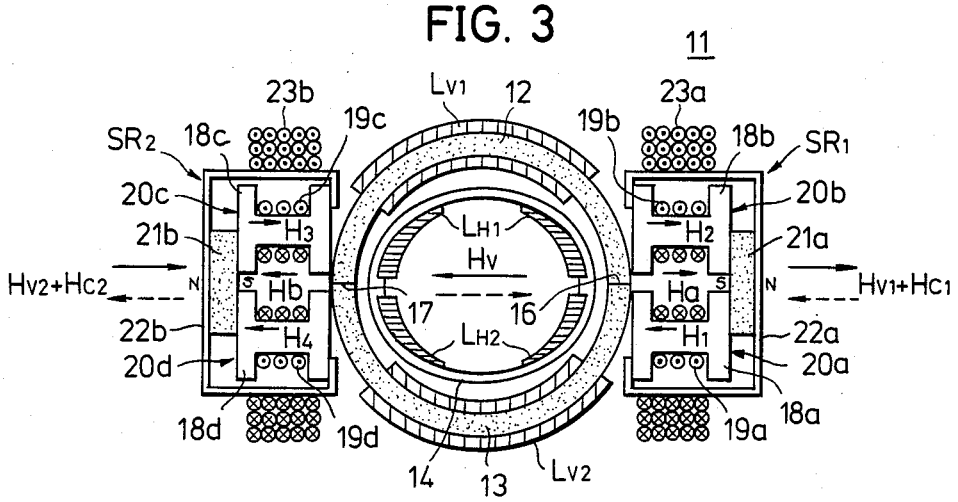
Figure 4:
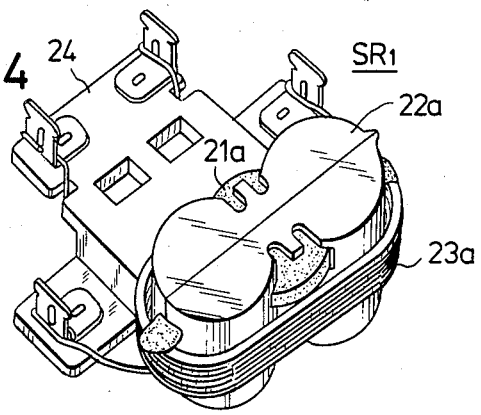
FIG. 4 is a perspective view showing a saturable reactor constituting the convergence correction apparatus according to the present invention.

A shown in FIGS. 3 and 4, the saturable reactor SR1 comprises coil bodies 20*a* and 20*b* having coils 19*a* and 19*b* wound on respective drum-shaped cores 18*a* and 18*b*, a permanent magnet 21*a* for D.C. magnetic biasing, a case 22*a* which accommodates the coil bodies 20*a* and 20*b* and the permanent magnet 21*a*, and an auxiliary control coil 23*a* wound on the outer periphery of the case 22*a*. Similarly, the saturable reactor SR2 comprises coil bodies 20*c* and 20*d* having coils 19*c* and 19*d* wound on respective drum-shaped cores 18*c* and 18*d*, a permanent magnet 21*b* for D.C. magnetic biasing, a case 22*b* which accommodates the coil bodies 20*c* and 20*d* and the permanent magnet 21*b*, and an auxiliary control coil 23*b* wound on the outer periphery of the case 22*b*. As shown in FIG. 2, the saturable reactor SR1 has a terminal plate 24 integrally provided on the case 22*a*, and the saturable reactor SR1 is mounted by fixing this terminal plate 24 on a cylindrical flange 25 of the separator 14. The saturable reactor SR2 is mounted similarly as the saturable reactor SR1.

The coils 19*a* and 19*b* are wound so that the winding directions thereof are in mutually opposite directions. Similarly, the coils 19*c* and 19*d* are wound so that the winding directions thereof are in mutually opposite directions.

Description will be given with respect to the circuit construction of the present embodiment of the convergence correction apparatus according to the present invention by referring to FIG. 1A. In FIG. 1A, the saturable reactor SR1 has external connection terminals (a1), (a2), (d1) and (d2). The coils 19*a* and 19*b* are coupled in series between the terminals (a1) and (a2), and the auxiliary control coil 23*a* is coupled between the terminals (d1) and (d2). Similarly, the saturable reactor SR2 has external connection terminals (b1), (b2), (c1) and (c2). The coils 19*c* and 19*d* are coupled in series between the terminals (b1) and (b2), and the auxiliary control coil 23*b* is coupled between the terminals (c1) and (c2).

A series circuit comprising the horizontal deflecting coil $L_{H1}$ and the coils 19*a* and 19*b* and a series circuit comprising the horizontal deflecting coil $L_{H2}$ and the coils 19*c* and 19*d* are coupled in parallel between terminals T1 and T2. A horizontal deflection current $I_H$ is applied to the terminal T1. A parallel circuit having diodes D1 and D2 coupled to each other with opposite polarities, and the vertical deflecting coils $L_{V1}$ and $L_{V2}$ are coupled in series between terminals T3 and T4. A vertical deflection current $I_V$ is applied to the terminal T3. Instead of the parallel circuit comprising the diodes D1 and D2, it is possible to use a series circuit shown in FIG. 1B comprising zener diodes $Z_{D1}$ and $Z_{D2}$.

On the other hand, the terminals (c1) and (d1) are respectively coupled to a connection point of the vertical deflecting coil $L_{V2}$, a cathode of the diode D1 and an anode of the diode D2. The terminals (c2) and (d2) are respectively coupled to a connection point of the terminal T3, an anode of the diode D1 and a cathode of the diode D2.

Accordingly, the horizontal deflection current $I_H$ is supplied to the coils 19*a* through 19*d*, and the vertical deflection current $I_V$ is supplied to the auxiliary control coils 23*a* and 23*b*.

The permanent magnets 21*a* and 21*b* respectively have a disc shape with a groove formed in the diametrical direction thereof, and are mounted so as to be manually rotatable. D.C. bias magnetic fields are variably adjusted by rotating the permanent magnets 21*a* and 21*b*.

Figure 15:
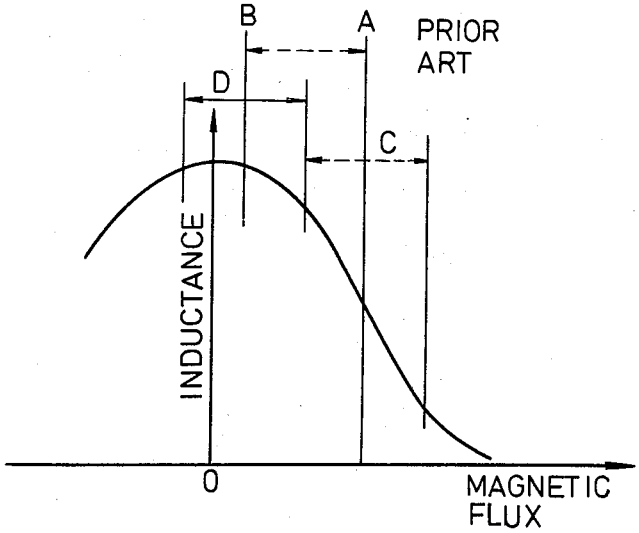
FIG. 15 shows the change in the inductance of the coil of the saturable reactor according to a conventional convergence correction method.

According to the method disclosed in the Japanese Laid-Open Patent Application No. 57-206184 described before, the permanent magnets 21*a* and 21*b* are rotated to reduce the D.C. magnetic bias quantity from a quantity A to a quantity B as shown in FIG. 15 so as to shift an operating range C of control magnetic fields acting on the saturable reactors SR1 and SR2 to an operating range D. However, this method suffers the problems described before such as poor productivity.

Returning now to the description of the embodiment, magnetic fields H1 and H2 generated by the coils 19*a* and 19*b* and a D.C. bias magnetic field Ha generated by the permanent magnet 21*a* exist inside the saturable reactor SR1 as shown in FIG. 3. Similarly, magnetic fields H3 and H4 generated by the coils 19*c* and 19*d* and a D.C. bias magnetic field Hb generated by the permanent magnet 21*b* exist inside the saturable reactor SR2.

The vertical deflection current $I_V$ for deflecting the electron beam in the vertical direction of the screen and having a sawtooth waveform is applied to the vertical deflection coils $L_{V1}$ and $L_{V2}$. Hence, a vertical deflection magnetic field $H_V$ which varies in direction as indicated by a solid line or a phantom line in FIG. 3 is generated inside the core depending on the vertical deflection current $I_V$. In addition, leakage magnetic field $H_{V1}$ and $H_{V2}$ having the vertical deflection period are generated from the core depending on the vertical deflection magnetic field $H_V$.

On the other hand, the winding directions of the auxiliary control coils 23*a* and 23*b* are selected so as to generate auxiliary control magnetic fields $H_{C1}$ and $H_{C2}$ respectively having the same polarities as the leakage magnetic fields $H_{V1}$ and $H_{V2}$. Thus, control magnetic fields $H_{V1}+H_{C1}$ and $H_{V2}+H_{C2}$ are generated outside the core.

The inductances of the coils 19*a* and 19*b* of the saturable reactor SR1 which are coupled between the terminals (a1) and (a2) change depending on the change in the control magnetic field $H_{V1}+H_{C1}$. Similarly, the inductances of the coils 19*c* and 19*d* of the saturable reactor SR2 which are coupled between the terminals (b1) and (b2) change depending on the change in the control magnetic field $H_{V2}+H_{C2}$.

Accordingly, the convergence correction apparatus of the present invention is designed to correct the convergence error by varying the circuit impedance of the horizontal deflecting coils $L_{H1}$ and $L_{H2}$ by the control magnetic fields $H_{V1}+H_{C1}$ and $H_{V2}+H_{C2}$ which change with the vertical deflection period and by magnetic fields H1 through H4 which are generated by the horizontal deflection current $I_H$ flowing through the coils 19*a* through 19*d*.

Threshold voltages (for example, in the order of 0.7 volts) at which the diodes D1 and D2 are turned ON or the zener voltages of the zener diodes $Z_{D1}$ and $Z_{D2}$ are set so as to to coincide with terminal voltages of the auxiliary control coils 23*a* and 23*b* at the time when the electron beam is deflected to approximately an intermediate portion in the vertical deflecting direction. The threshold voltages and the zener voltages will hereinafter be referred to as turn-on voltages.

Figure 5:
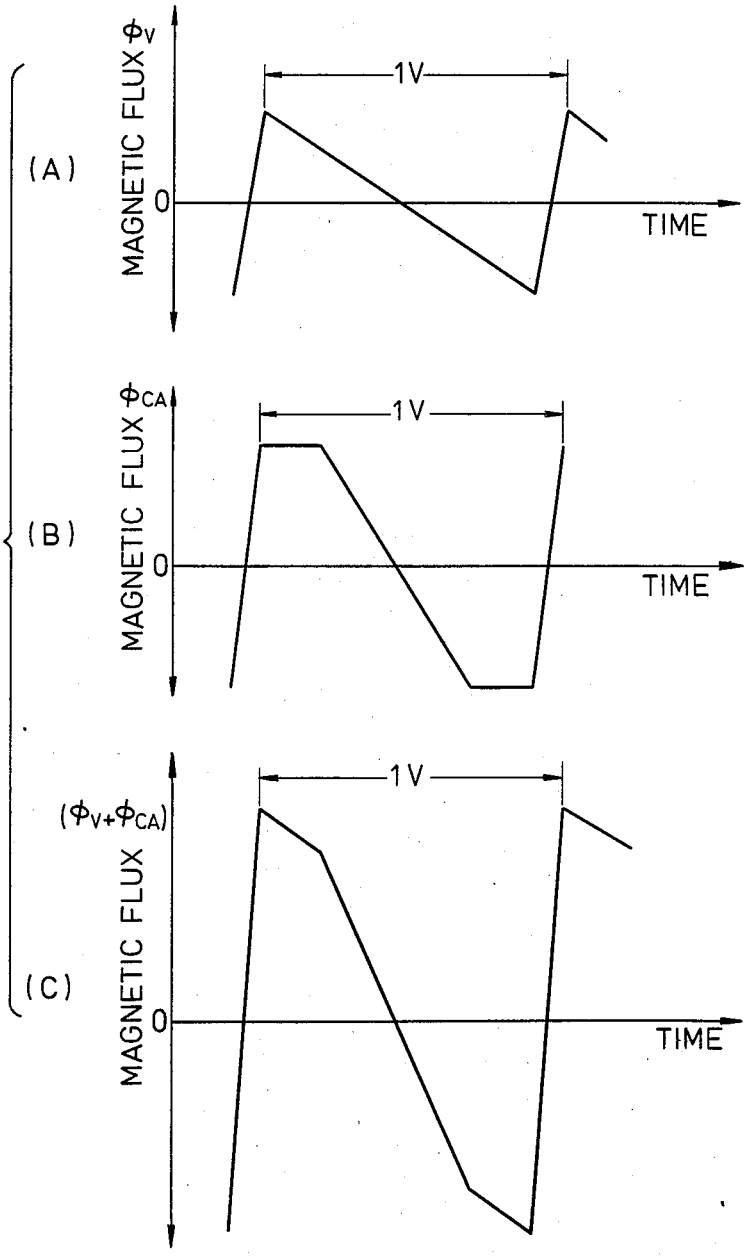
FIGS. 5(A) through 5(C) respectively show an embodiment of magnetic fluxes generated by the circuit shown in FIG. 1A.

As shown in FIG. 5(A), a leakage magnetic flux $\phi_V$ (magnetic flux corresponding to the magnetic fields $H_{V1}$ and $H_{V2}$) of the vertical deflecting coils $L_{V1}$ and $L_{V2}$ has a sawtooth waveform with respect to time and is proportional to the vertical deflection current $I_V$. In FIG. 5(A) and figures which follow, one vertical deflection period is denoted by 1V. A magnetic flux $\phi_{CA}$ (magnetic flux corresponding to the control magnetic fields $H_{C1}$ and $H_{C2}$) of the of the auxiliary control coils 23*a* and 23*b* has a waveform shown in FIG. 5(B). As shown in FIG. 5(B), the magnetic flux $\phi_{CA}$ has a waveform that increases as the vertical deflection current $I_V$ increases until the terminal voltages of the auxiliary control coils 23*a* and 23*b* reach the turn-on voltages, and remains constant when the terminal voltages exceed the turn-on voltages. Accordingly, a magnetic flux $\phi_V+\phi_{CA}$ shown in FIG. 5(C) which has a waveform obtained by adding the waveforms shown in FIGS. 5(A) and 5(B) and a magnetic flux $\phi_{DC}$ (magnetic flux corresponding to the D.C. bias magnetic fields Ha and Hb) of the permanent magnets 21*a* and 21*b* act on the coils 19*a* through 19*d* of the saturable reactors SR1 and SR2.

Figure 6:
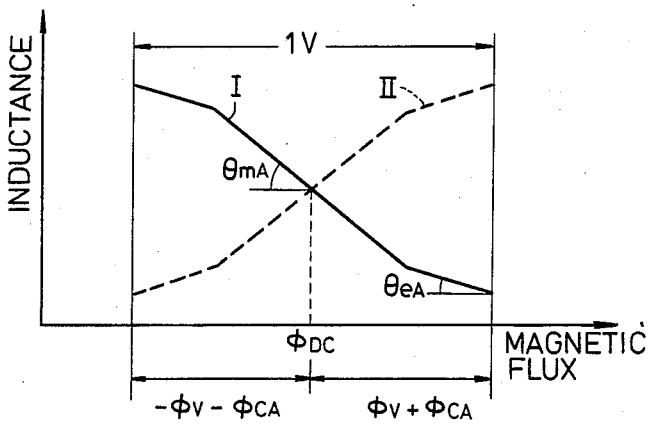
FIG. 6 shows changes in inductances of coils of the saturable reactors caused by the magnetic fluxes shown in FIGS. 5(A) through 5(C)

In this case, the inductances of the coils 19*a* through 19*d* change as shown in FIG. 6. In FIG. 6, a solid line I indicates the inductance changes of the coils 19*b* and 19*d*, and a phantom line II indicates the inductance changes of the coils 19*a* and 19*c*. The inductance change curves I and II are symmetrical to each other to the right and left about the magnetic flux $\phi_{DC}$, and have magnetic flux changing range comprising a magnetic flux change quantity $\phi_V+\phi_{CA}$ for the case where the deflection is to take place toward the top of the screen about the magnetic flux $\phi_{DC}$ and a magnetic flux change quantity $-\phi_V-\phi_{CA}$ for the case where the deflection is to take place toward the bottom of the screen about the magnetic flux $\phi_{DC}$.

Figure 14:
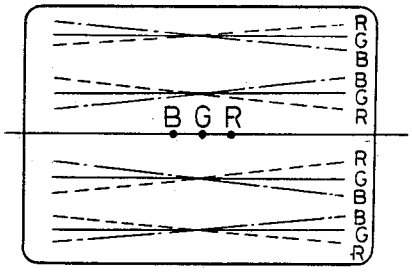
FIG. 14 PRIOR ART

When a differential coefficient of the inductance change curve at the central portion of the screen where the vertical deflection is extremely small is denoted by $\theta$mA and a differential coefficient of the inductance change curve at the top and bottom portion of the screen where the vertical deflection is a maximum is denoted by $\theta$eA in the inductance change curves I and II in FIG. 6, $\theta$mA becomes greater than $\theta$eA and the extent of the increase of the convergence correction quantity of the horizontal lines decreases as the vertical deflection angle increases. The differential coefficients respectively describe the rate of change of the inductance. In other words, in the present embodiment, the convergence correction quantity is made smaller in the peripheral portion of the screen compared to that in the central portion of the screen. As shown in FIG. 14, the misconvergence pattern shown in FIG. 14 becomes a problem in the conventional apparatus, wherein the correction is insufficient at the central portion of the screen and the correction is in excess at the peripheral portion of the screen. However, according to the present embodiment, it is possible to correct such a misconvergence pattern.

Figure 12:
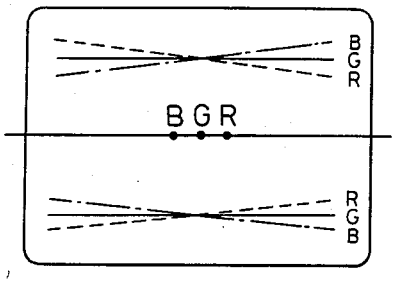
FIG. 12 PRIOR ART
FIGS. 12, 13 and 14 respectively show examples of misconvergence patterns generated in a conventional apparatus.
Figure 13:
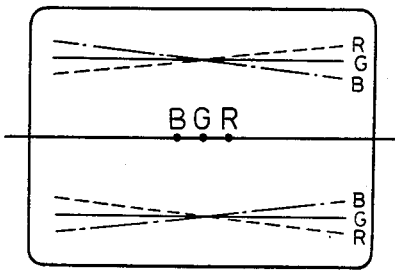
FIG. 13 PRIOR ART

When the negative trilemma misconvergence pattern shown in FIG. 13 which is generated in the case of a large picture tube such as a 20-inch picture tube having a deflection angle of 90° is corrected in the conventional apparatus with a polarity opposite to that in the case of the positive trilemma miscovergence pattern shown in FIG. 12, a remaining miscovergence pattern becomes similar to that shown in FIG. 14. However, in this case, unlike the misconvergence pattern shown in FIG. 14, the correction performed by the saturable reactors SR1 and SR2 is in excess at the central portion of the screen and the negative trilemma misconvergence pattern occurs, while the correction is insufficient at the peripheral portion of the screen and the positive trilemma misconvergence pattern occurs.

Accordingly, in order to correct the above misconvergence pattern, the connection of the saturable reactors SR1 and SR2 is reversed in FIG. 1A. In addition, the coils 19*c* and 19*d* are coupled between the terminals (a1) and (a2) and the coils 19*a* and 19*b* are coupled between the terminals (b1) and (b2). On the other hand, it is possible to leave the connection as it is in FIG. 1A and reverse the polarity of the permanent magnets 21*a* and 21*b* shown in FIG. 3 and reverse the generation direction of the D.C. bias magnetic field $H_{DC}$. By taking such measures, the direction of the magnetic flux $\phi_{CA}$ of the auxiliary control coils 23*a* and 23*b* and the direction of the leakage magnetic flux $\phi_V$ of the vertical deflecting coils $L_{V1}$ and $L_{V2}$ become opposite to each other. In this case, it is of course possible to couple the diodes D1 and D2 or the zener diodes $Z_{D1}$ and $Z_{D2}$ in parallel with the auxiliary control coils 23*a* and 23*b*.

Figure 7:
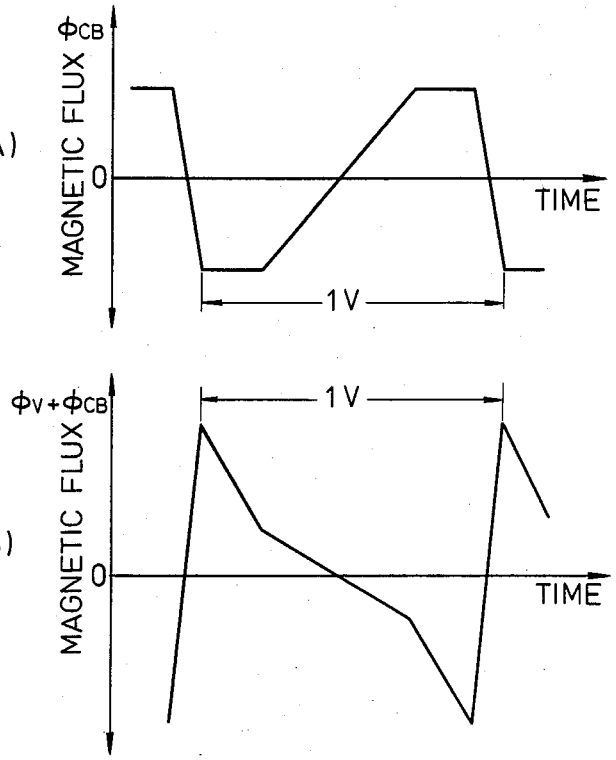
FIGS. 7(A) and 7(B) respectively show another embodiment of the magnetic fluxes generated by the circuit shown in FIG. 1A.
Figure 8:
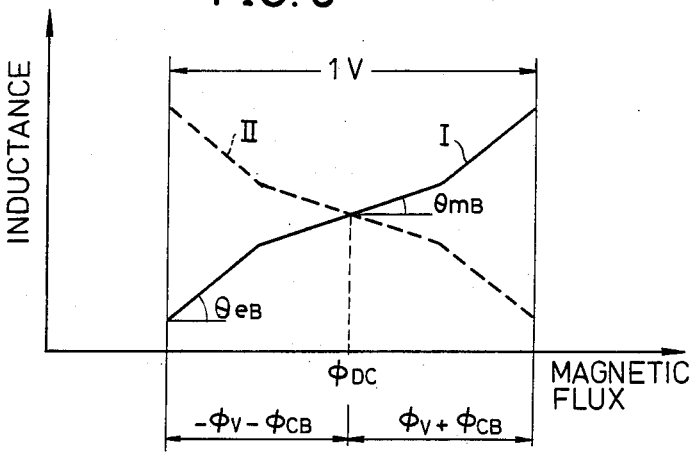
FIGS. 8, 9 and 10 respectively show the changes in the inductances of the coils of the saturable reactors caused by the magnetic fluxes shown in FIGS. 7(A) and 7(B)

In this case, a magnetic flux $\phi_{CB}$ of the auxiliary control coils 23*a* and 23*b* having the vertical deflection period becomes as shown in FIG. 7(A) wherein a waveform thereof is of a reverse polarity compared to the waveform of the magnetic flux $\phi_{CA}$ shown in FIG. 5(B). Accordingly, a magnetic flux $\phi_V+\phi_{CB}$ acting on the coils 19*a* through 19*d* of the saturable reactors SR1 and SR2 becomes as shown in FIG. 7(B). As a result, inductance change curves of the coils 19*a* through 19*d* become as shown in FIG. 8 which have a reverse polarity compared to those shown in FIG. 6. Furthermore, the magnetic flux change quantities become $\phi_V+\phi_{CB}$ and $-\phi_V-\phi_{CB}$.

When a differential coefficient of the inductance change curve at the central portion of the screen where the vertical deflection is extremely small is denoted by $\theta$mB and a differential coefficient of the inductance change curve at the top and bottom portion of the screen where the vertical deflection is a maximum is denoted by $\theta$eB in the inductance change curves I and II in FIG. 8, $\theta$mB becomes smaller than $\theta$eB and the extent of the increase of the convergence correction quantity of the horizontal lines increases as the vertical deflection angle increases. In other words, in this case, the convergence correction quantity is made larger in the peripheral portion of the screen compared to that in the central portion of the screen. Thus, the misconvergence pattern in which the correction is in excess at the central portion of the screen and the correction is insufficient in the peripheral portion of the screen remains when the negative trilemma misconvergence pattern is corrected, but it is possible to correct such a misconvergence pattern.

Figure 9:
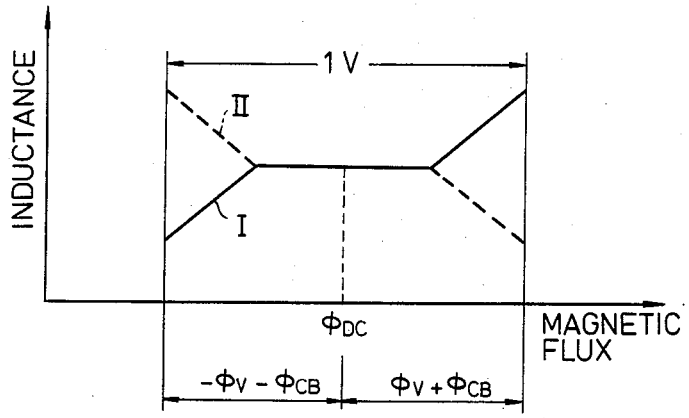
Figure 10:
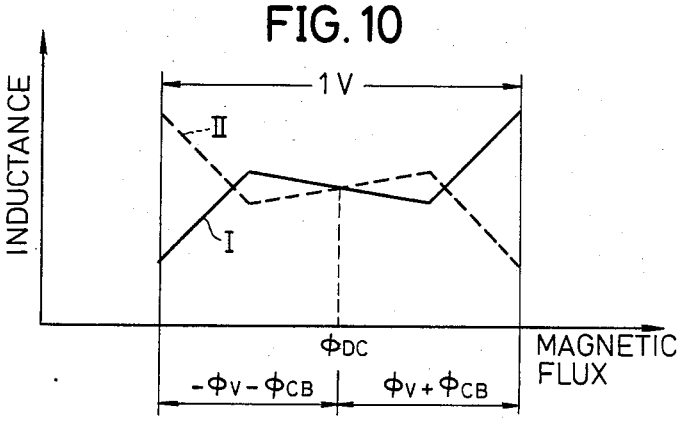

It is possible to vary the inductance change curves of the coils 19*a* through 19*d* as shown in FIGS. 8 through 10 by changing a ratio of an absolute value of the leakage magnetic flux $\phi_V$ of the vertical deflecting coils $L_{V1}$ and $L_{V2}$ and an absolute value of the magnetic flux $\phi_{CB}$ of the auxiliary control coils 23*a* and 23*b*, that is, by changing a turns ratio of the vertical deflecting coils $L_{V1}$ and $L_{V2}$ and the auxiliary control coils 23*a* and 23*b*. Accordingly, it is possible to perform an optimum convergence correction by setting the inductance change curves in accordance with the misconvergence pattern of the horizontal lines by changing the turns ratio.

When the terminal voltages of the auxiliary control coils 23*a* and 23*b* are under the turn-on voltages described before, the relationships between the turns ratio (that is, the ratio of the absolute values of the magnetic fluxes $\phi_V$ and $\phi_{CB}$) and FIGS. 8 through 10 become as follows.

$|\phi_V| > |\phi_{CB}| \rightarrow$ FIG. 8

$|\phi_V| = |\phi_{CB}| \rightarrow$ FIG. 9

$|\phi_V| < |\phi_{CB}| \rightarrow$ FIG. 10

Figure 11:
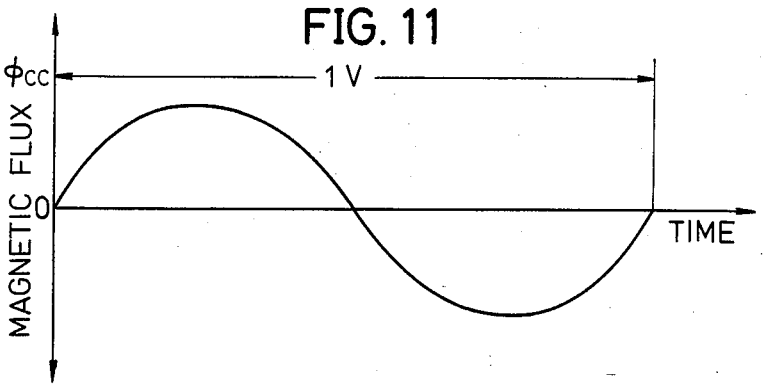
FIG. 11 shows an embodiment of an auxiliary control magnetic flux generated by the convergence correction apparatus according to the present invention.

The control magnetic flux acting on the saturable reactors SR1 and SR2 is not limited to $|\phi_V+\phi_{CA}|$ or $|\phi_V+\phi_{CB}|$. For example, the magnetic flux acting on the saturable reactors SR1 and SR2 may only be the magnetic flux $|\phi_{CA}|$ or $|\phi_{CB}|$ of the auxiliary control coils 23*a* and 23*b*. In addition, the vertical deflection current supplied to the auxiliary control coils 23*a* and 23*b* is not limited to the current rectified in the diodes. For example, it is possible to shape the current by use of active elements and generate a complex magnetic flux $\phi_{CC}$ such as that shown in FIG. 11 in accordance with the convergence error so as to perform the convergence correction.

Further, the present invention is not limited to these embodiments, but various variations and modifications may be made without departing from the scope of the present invention.

What is claimed is:

1. A convergence correction apparatus comprising:

a pair of horizontal deflecting coils supplied with a horizontal deflection current for producing a horizontal deflection magnetic field;

a pair of vertical deflecting coils supplied with a vertical deflection current for producing a vertical deflection magnetic field, said pair of horizontal deflecting coils and said pair of vertical deflecting coils constituting a deflection yoke of a self-convergence system color picture tube in which dynamic convergence alignment of three electron beams from three electron guns having an in-line arrangement is automatically performed by said horizontal and vertical deflection magnetic fields, said pair of vertical deflecting coils producing leakage magnetic fluxes each of which has a sawtooth waveform with respect to time and has a period equal to a vertical deflection period depending on said vertical deflection current;

saturable reactors coupled to said pair of horizontal deflecting coils for correcting convergence error in horizontal lines by varying said horizontal deflection current depending on said leakage magnetic fluxes and said horizontal deflection magnetic field so that a distribution of the horizontal deflection magnetic field is changed with time;

auxiliary control coils coupled to the vertical deflecting coils and wound on the saturable reactors for varying inductances of coils of the saturable reactors by auxiliary control magnetic fluxes generated by the auxiliary control coils; and correcting means coupled to said pair of vertical deflecting coils and said auxiliary control coils for producing from said vertical deflection current a correcting current which has a waveform other than a sawtooth waveform and has a period equal to the vertical deflection period, and for supplying said correcting current to said auxiliary control coils to non-linearly vary magnitudes of the auxiliary magnetic fluxes generated by said auxiliary control coils, said correcting means comprising diode circuit means coupled in parallel to said auxiliary control coils.

2. A convergence correction apparatus as claimed in claim 1 in which said auxiliary control coils are wound on said saturable reactors so as to generate the auxiliary control magnetic fluxes in directions respectively the same as those of said leakage magnetic fluxes.

3. A convergence correction apparatus as claimed in claim 1 in which said auxiliary control coils are wound on said saturable reactors so as to generate the auxiliary control magnetic fluxes in directions respectively opposite to those of said leakage magnetic fluxes.

4. A convergence correction apparatus as claimed in claim 1 in which said diode circuit means comprises a parallel circuit coupled in parallel to said auxiliary control coils, said parallel circuit comprising at least a pair of diodes coupled to each other with opposite polarities, said diodes having threshold voltages which coincide with terminal voltages of said auxiliary control coils at a time when an electron beam is deflected to approximately an intermediate portion in a vertical deflecting direction.

5. A convergence correction apparatus as claimed in claim 1 in which said diode circuit means comprises a series circuit coupled in parallel to said auxiliary control coils, said series circuit comprising at least a pair of zener diodes coupled to each other with opposite polarities, said zener diodes having zener voltages which coincide with terminal voltages of said auxiliary control coils at a time when an electron beam is deflected to approximately an intermediate portion in a vertical deflecting direction.

6. A convergence correction apparatus as claimed in claim 1 in which said correcting means varies the magnitudes of said auxiliary control magnetic fluxes non-linearly so that a differential coefficient m corresponding to a central portion of a screen is greater than a differential coefficient e corresponding to each of top and bottom portions of the screen said differential coefficients representing rates of change of inductances of the coils of said saturable reactors caused by said leakage and auxiliary magnetic fluxes, whereby a rate of increase of convergence correction quantity of the horizontal lines decreases as a vertical deflection angle increases.

7. A convergence correction apparatus as claimed in claim 1 in which said correcting means varies the magnitudes of said auxiliary control magnetic fields non-linearly so that a differential coefficient m corresponding to a central portion of a screen than a differential coefficient e corresponding to each of top and bottom portions of the screen said differential coefficients representing rates of change of inductances of the coils of said saturable reactors caused by said leakage and auxiliary magnetic fluxes, whereby a rate of increase of convergence correction quantity of the horizontal lines increases as a vertical deflection angle increases.

8. A convergence correction apparatus as claimed in claim 1 in which said correcting means varies the magnitudes of said auxiliary control magnetic fluxes non-linearly by arbitrarily setting a winding ratio of said pair of vertical deflecting coils and said auxiliary control coils, whereby inductance change curves indicating changes in inductances of the coils of said saturable reactors within one vertical deflection period are set to prevent generation of misconvergence pattern of the horizontal lines throughout the entire screen.

* * * * *